US005484230A

United States Patent [19]

Rudloff

[11] Patent Number: 5,484,230

[45] Date of Patent: Jan. 16, 1996

[54] CONCRETE BLOCK REVETMENT SYSTEM FOR SOIL EROSION PREVENTION

[76] Inventor: Terry R. Rudloff, Rte. 2 Box 95, Fayetteville, Tex. 78940

[21] Appl. No.: 272,076

[22] Filed: Jul. 8, 1994

[51] Int. Cl.[6] ..... E02B 3/12

[52] U.S. Cl. ..... 405/20; 52/606; 404/35; 404/40; 404/41; 405/16; 405/19

[58] Field of Search ..... 405/16–20; 404/35–42; 52/606–611

[56] References Cited

U.S. PATENT DOCUMENTS

| | | | |
|---|---|---|---|
| 4,227,829 | 10/1980 | Landry | 405/20 |
| 4,370,075 | 1/1983 | Scales | 405/20 |
| 4,375,928 | 3/1983 | Crow et al. | 405/17 X |
| 4,436,447 | 3/1984 | Crowe | 405/16 |

FOREIGN PATENT DOCUMENTS

| | | | |
|---|---|---|---|
| 59044 | 12/1967 | Germany | 405/20 |
| 2139676 | 11/1984 | United Kingdom | 405/20 |

*Primary Examiner*—Dennis L. Taylor
*Attorney, Agent, or Firm*—William J. Beard

[57] ABSTRACT

A system of concrete blocks is provided for use as a revetment for preventing soil erosion in which individual blocks are sized and shaped to be cable interconnected to form a matrix or mats. The matrix or mat or blocks overlies and holds in place a layer of porous and permeable geo-textile overlying the protected soil area. The shape of the individual blocks is such as to permit growth of vegetation therethrough and to channel water flowing over the surface of the blocks to increase the downward pressure on the geo-textile layer.

6 Claims, 1 Drawing Sheet

CONCRETE BLOCK REVETMENT SYSTEM FOR SOIL EROSION PREVENTION

BACKGROUND OF THE INVENTION

This invention relates generally to precast concrete blocks and matrices or mats thereof used for the formation of revetments for holding soil in place and preventing the erosion thereof by water movement. Typically application of such mats or revetments are along steeply inclined canal or stream banks, along beach seawalls and along highway overpass embankments and the like. Similarly, the bottom of canal locks for the passage of vessels or steeply inclined drainage ditches or the like are also susceptible of soil erosion by the rapid movement of water across them.

The use of soil erosion prevention blocks and other revetment structures are known in the art. Typically a geo-textile comprising a highly porous and permeable heavy duty cloth mat is laid in place over the area to be protected. This geo-textile is then weighted down by heavy blocks of concrete or the like or by interconnected matrices of such heavy blocks. In the known prior art to the applicant the weight of such blocks and the geo-textile used in conjunction therewith prevent surface movement of the soil below the geo-textile. Pertinent prior art patents include U.S. Pat. No. 4,227,829 to Landry which discloses the use of a matrix of blocks, cable interconnected, in transverse and longitudinal directions and shaped to form an interlocking arrangement when placed together. U.S. Pat. No. 4,370,075 to Scales shows weighting blocks which are shaped to form an interlocked grid in one horizontal dimension while being cable interlocked in the second horizontal dimension. Both of these blocks have cable passage holes passing horizontally therethrough although the Scales blocks appear to have these only in one direction. Other U.S. patents showing features related to this use of weighting blocks are: U.S. Pat. No. 4,564,311 to Scales; U.S. Pat. No. 991,041 to Toennes; U.S. Pat. No. 5,087,150 to McCreary; U.S. Pat. No. 5,020,938 to Scales; U.S. Pat. No. 4,875,803 to Scales; U.S. Pat. No. 4,781,492 to Shined; U.S. Pat. No. 4,683,156 to Waters; U.S. Pat. No. 4,465,398 to Knudsen; U.S. Pat. No. 4,436,447 to Crowe and U.S. Pat. No. 4,375,928 to Crow et al. These patents are cited as being of interest but merely cumulative examples of different features of such blocks and systems thereof. For example some of these blocks may be interconnected by cables while some are held in place by vertical pilings driven through vertical holes in the blocks. While some of the blocks disclose complex three dimensional shapes to allow relative movement to each other vertically when arranged in a horizontal matrix, others have complex three dimensional shapes to allow growth of plants through them when in place or to allow sand or soil to be placed therebetween.

A common problem in all such block weighting systems is to provide a simple geometrical shape which may be economically formed by precast blocks. Similarly, it is desirable to be able to prefabricate matrices or mats of such blocks which may be strung together at a factory assembly point and handled together for shipping and laying in place rather than to have to lay in place individually at the usage site.

SUMMARY OF THE INVENTION

The present invention is directed to a precast concrete block and matrices or mats thereof for use in the prevention of soil erosion. The individual blocks which are each identical have a simple geometrical shape optimized for precasting on a typical vibrating table forming machine. Cable tunnels or passageways are provided in both horizontal directions through the blocks of the present invention. This allows easy interconnection of the blocks at a factory assembly point into desired sized mats or matrices of the blocks. Thus preassembled mats may be vertically stacked for shipping on flatbed trucks or railroad cars. Such mats or matrices then may be placed by crane using a spreader bar for handling at the usage site. Additionally the simple geometrical shape of the blocks allows growth of plants therethrough in a fresh water environment or the infill thereof by sand or soil in a salt water environment. This assists in holding the block mat or matrices in place in the presence of moving water. This of course is in addition to anchoring by fastening of the interconnect cables to pilings, anchors, seawalls or the like as desired.

The blocks are also shaped with an inward tapered upper surface on approximately the upper ½ of the vertical sides. These tapered surfaces form channels directing water moving over the blocks up and over the top surfaces of the blocks which causes downward forces on the blocks to increase in the presence of flowing water. This assists in holding the underlying geo-textile in place preventing soil erosion.

Other features and advantages of the block revetment system of the present invention will become more apparent when considering the following detailed description thereof when taken in conjunction with the accompanying drawings. These descriptions are illustrative only and not limitative of the invention.

DETAILED DESCRIPTION OF THE INVENTION

Figure 1:
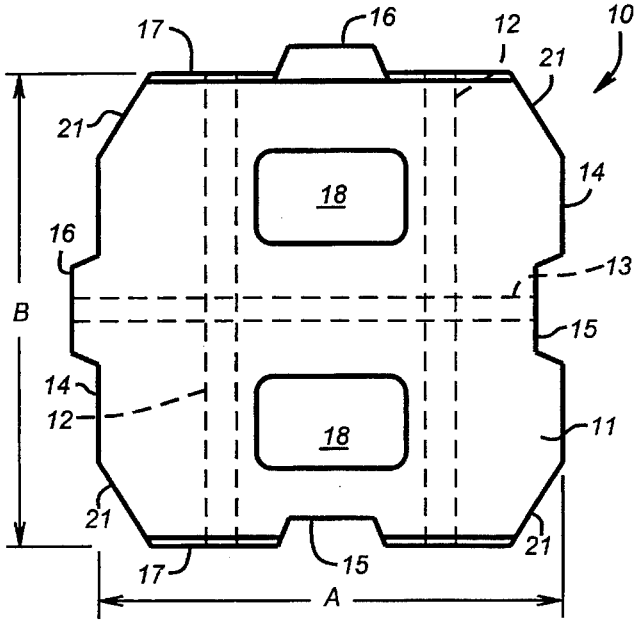
FIG. 1 is top view of an individual block according to the invention for use in preventing soil erosion.
Figure 2:
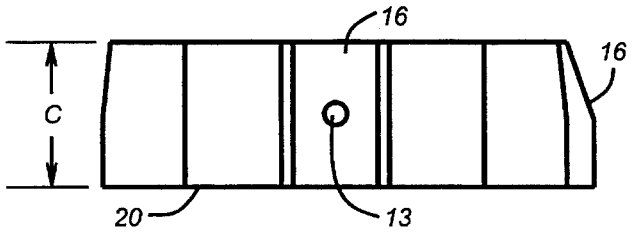
FIG. 2 is a side view of the block of FIG. 2 from the left side of the view of FIG. 2.
Figure 3:
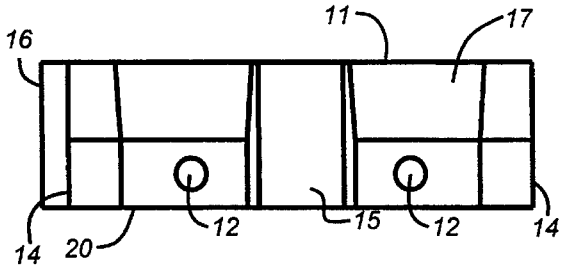
FIG. 3 is a side view of the block of FIG. 1 from the upper side of the view of FIG. 1.

Referring now to FIGS. 1, 2 and 3 of the drawings, views of a precast concrete block according to the invention are shown from a top view and two side views respectively. In FIG. 1, a view down onto the top surface of the block is shown. In the preferred embodiment shown generally at 10 in FIG. 1 the block has a generally rectangular shape having dimensions labelled A and B. In practice a generally square cross section block, (i.e. A=B) has been found to be preferable, although rectangular blocks could be used in special instances. The upper surface of block 10 is designated by the numeral 11 and is flat and plane parallel to the bottom surface (not shown) of the block.

Block 10 is provided generally with four faces in two generally parallel pairs numbered 14 and 17. Faces 14 are generally parallel with each other and faces 17 are generally parallel with each other although as may be seen in the side views of FIGS. 3 and 4 the upper portions of these faces taper inwardly at a slight angle making the top surface 11 of the block (FIG. 1) slightly smaller than its bottom surface 20 (FIGS. 2+3).

The block 10 is provided with two transverse cable tunnels or bores 12 extending between parallel face pairs 17 and a single cable tunnel or bore 13 extending between parallel face pairs 14. These bores are sized to allow cables (not shown) to be passed therethrough completely transversing block 10 in each horizontal direction.

Parallel faces 17 are provided one with a male key tab 16 and the opposite with a female key tab 15. Similarly parallel face pairs 14 are provided one with a male key tab 16 and the opposite with a female key tab 15. Key tabs 15 are sized to easily receive key tabs 16 and extend only a short distance into and out of the pairs of parallel faces 14 and 17 into which they are formed. When a plurality of blocks 10 are cabled together to form a matrix or mat as shown in FIG. 4, these male and female key tabs 15 and 16 interact to maintain proper alignment of the blocks 10 in the array.

Referring again to FIGS. 1, 2 and 3 the block 10 may, if desired, be provided with vertically extending openings 18 from top surface 11 to bottom surface 20. The openings 18 are not necessary and may be deleted to increase the weight of an individual block if desired. If these openings 18 are provided, then they provide openings through which vegetation may grow from the earth through the geo-textile layer and the covering concrete block mats. This can assist in holding the blocks of an array such as shown in FIG. 4 in place.

It will be noted that the corners 21 of the upper and lower surfaces 11 and 20 are chopped off or truncated. Thus when the blocks 10 are arranged into a mat (30 of FIG. 4) by cabling them together as shown in FIG. 4 the area where these four corners 21 would come together in left as a plurality of openings extending vertically through the matrix or mat 30 of blocks as shown in FIG. 4. The array of vertical holes thus formed also permits the growth of vegetation therethrough, assisting in anchoring the mat 30 in a fresh water environment. In saline environments or where otherwise vegetation cannot grow the vertical openings 18 and those provided by the truncated corners 21 can fill with soil or sand and thus assist in holding the mat 30 in place.

Figure 4:
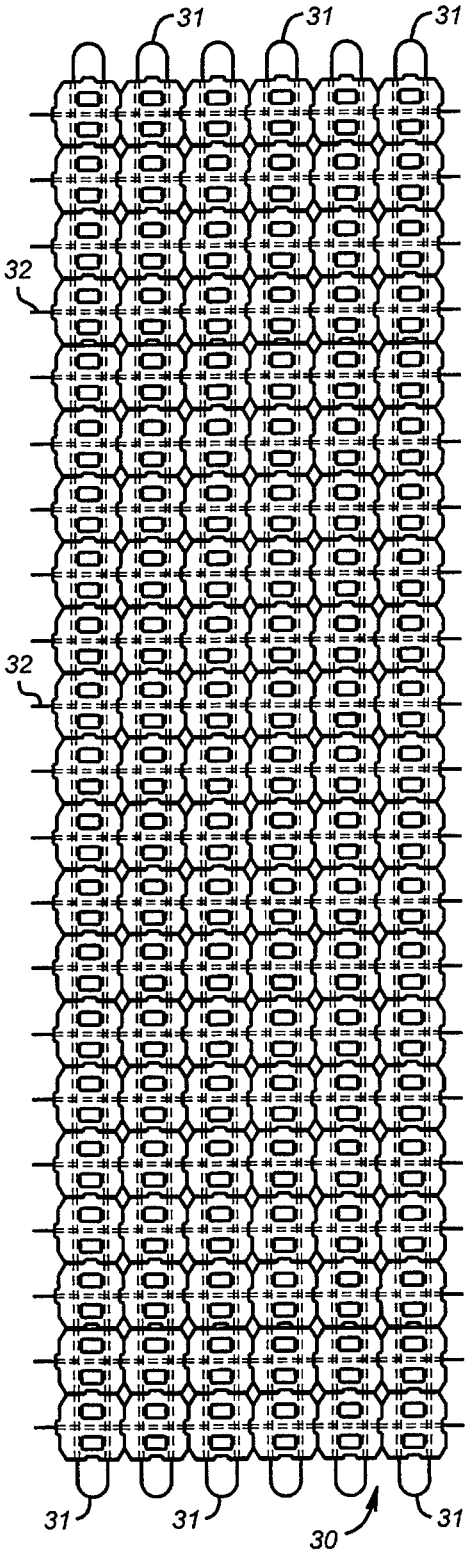
FIG. 4 is a schematic view showing a mat or matrix of the blocks of FIG. 1 in place and showing cables passing through the mat or matrices of blocks tying them together in an array of any desired size.

Referring now to FIG. 4 a matrix or mat 30 of blocks 10 is shown schematically. A single long cable 31 is used to pass through the longitudinal cable tunnels 12 of the individual blocks 10 forming a row of the array. Thus all blocks 10 are arranged into parallel longitudinal rows as shown in FIG. 4. Individual transverse cables 32 are passed through cable tunnels or passages 12 in each of the blocks 10. This provides a transverse structural member for the matrix 30. With the keyways male 16 and female 15 interacting as previously described then further assist in maintaining blocks 10 in order in the mat or matrix 30. Typically a matrix or mat 30 may be about 8 feet wide by 40 or 50 feet in length. This has proven to be a convenient size for shipping and for laying in place using a crane and spreader bar. In shipping the mats 30 can be precabled and stacked vertically to the full capacity of the flatbed vehicle carrying the blocks.

The blocks are not cabled together to form the mat 30 as tightly as possible. Some slack is left in the cables 31 and 32. This slack provides flexibility in the vertical and longitudinal directions which is useful in handling and placing the mat 30 in their usage positions. Cables 31 are generally affixed to anchors, pilings or a seawall or retaining wall of some type, thus permanently affixing the mat or matrix 30 in its usage position. Cables 32 are generally attached to adjoining mat 30 to make a continuous transverse connection.

The transverse, longitudinal and vertical dimensions of each block 10 may be as desired. A convenient size for handling has been found to be 16 inches×16 inches×6 inches which results in a 93 pound block. Of course thicker blocks than 6 inches will be heavier while thinner ones will be lighter. The blocks may be lightened somewhat by providing the vertical openings 18 previously discussed.

It will be appreciated by those skilled in the art that the foregoing descriptions and disclosures may make other embodiments of the invention apparent to those skilled artisans. The aim of the appended claims is to cover all such changes and modifications as lie within the true spirit and scope of the invention.

I claim:

1. A concrete block system for use in preventing soil erosion and comprising a plurality of blocks having:

(a) an upper surface and a lower surface each being generally of a square shaped cross section;

(b) a plurality of side surfaces comprising at least two pairs of opposite side surfaces being generally parallel to each other, each pair of said generally parallel surfaces having on one surface thereof a male key tab and on the opposite of said generally parallel surface a female key tab, said male and female key tabs being oriented vertically from said upper surface to said lower surface such that when engaged with other blocks they interact to restrict horizontal movement of the blocks (c) one pair of said generally parallel surfaces having at least two cable passages passing through said block and the other pair of said generally parallel surfaces having at least one cable tunnel extending therebetween through said blocks for the reception of cables so that when cables are placed therein an array of blocks is formed comprising a mat; and (d) at least one of said pairs of said generally parallel side surfaces having near said upper surface, an inward taper on each of said generally parallel surfaces, such that the area of said upper surface has a slightly smaller cross sectional area than said lower surface and whereby when plural blocks are laid in a side by side horizontal relationship said inwardly tapered surfaces form a channel between said blocks for the passage of flowing water thereby increasing the downward pressure of the flowing water across the surface of the block.

2. The block system of claim 1 and further including a plurality of such blocks interconnected by first cable member of a continuous nature passing therethrough in said surfaces having at least two cable passageways and having a plurality of second separate cable members having through said surfaces having at least one cable tunnel therethrough to form a generally rectangular matrix or mat of said blocks arranged in a side by side and end to end relationship and wherein said male and female key tabs interact to assist the location and to retain said blocks in said matrix array.

3. The system of claim 2 wherein said first set of cable members are all interconnected to provide continuity.

4. The system of claim 1 and further including at least one vertical opening interior to said upper and lower surfaces and interconnecting said upper and lower surfaces of the block.

5. The system of claim 4 wherein at least two such vertical openings are provided in each block.

6. The system of claim 1 wherein the corners of said upper and lower generally rectangular surfaces are truncated, thereby forming further vertical openings at each corner of intersection when the blocks are laid in a side by side and end to end relation to form a matrix of blocks.

* * * * *